US006464584B2

(12) United States Patent
Oliver

(10) Patent No.: US 6,464,584 B2
(45) **Date of Patent: *Oct. 15, 2002**

(54) INTELLIGENT CASINO CHIP SYSTEM AND METHOD FOR USE THEREOF

(75) Inventor: Terrance W. Oliver, Reno, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 32 days.

This patent is subject to a terminal disclaimer.

(21) Appl. No.: 09/767,654

(22) Filed: Jan. 22, 2001

(65) Prior Publication Data

US 2001/0016515 A1 Aug. 23, 2001

Related U.S. Application Data

(63) Continuation of application No. 09/167,847, filed on Oct. 7, 1998, now Pat. No. 6,186,895.

(60) Provisional application No. 60/061,297, filed on Oct. 7, 1997.

(51) Int. Cl.[7] ..... A63F 9/24

(52) U.S. Cl. ..... 463/25

(58) Field of Search ..... 463/16–20, 25–27, 463/39–43; 273/270–274; 235/435

(56) References Cited

U.S. PATENT DOCUMENTS

| | | | | |
|---|---|---|---|---|
| 2,410,845 A | | 11/1946 | Snell et al. | |
| 2,983,354 A | | 5/1961 | Ember et al. | |
| 3,034,643 A | | 5/1962 | Keller et al. | |
| 3,350,802 A | | 11/1967 | Segel | |
| 3,766,452 A | | 10/1973 | Burpee et al. | |
| D232,367 S | | 8/1974 | Garaventa | |
| D237,724 S | | 11/1975 | Garaventa | |
| D240,053 S | | 5/1976 | Garaventa | |
| 3,953,932 A | | 5/1976 | Graves | |
| 3,968,582 A | | 7/1976 | Jones | |
| 3,983,646 A | | 10/1976 | Howard | |
| 4,026,309 A | | 5/1977 | Howard | |
| 4,435,911 A | | 3/1984 | Jones | |
| 4,510,495 A | | 4/1985 | Sigrimis et al. | |
| 4,814,589 A | | 3/1989 | Storch et al. | |
| 4,939,354 A | | 7/1990 | Priddy et al. | |
| 5,088,093 A | | 2/1992 | Storch et al. | |
| 5,103,081 A | | 4/1992 | Fisher et al. | |
| 5,166,502 A | | 11/1992 | Rendleman et al. | |
| 5,216,234 A | | 6/1993 | Bell | |
| 5,283,422 A | | 2/1994 | Storch et al. | |
| 5,345,231 A | | 9/1994 | Koo et al. | |
| 5,361,885 A | | 11/1994 | Modler | |
| 5,367,148 A | | 11/1994 | Storch et al. | |
| 5,406,264 A | | 4/1995 | Plonsky et al. | |
| 5,451,756 A | | 9/1995 | Holzer et al. | |
| 5,548,110 A | | 8/1996 | Storch et al. | |
| 5,676,376 A | | 10/1996 | Valley | |
| 5,651,548 A | | 7/1997 | French et al. | |
| 5,951,011 A | | 7/1997 | Potter et al. | |
| 5,707,287 A | | 1/1998 | McCrea, Jr. | |
| 5,735,742 A | * | 4/1998 | French | 463/25 |
| 6,186,895 B1 | * | 2/2001 | Oliver | 463/25 |

FOREIGN PATENT DOCUMENTS

DE P 44 39 502.7 11/1994

OTHER PUBLICATIONS hitag, System Overview, mikron, brochure, 18 pages, 10/96.

* cited by examiner

*Primary Examiner*—Joe H. Cheng
*Assistant Examiner*—K. Nguyen
(74) *Attorney, Agent, or Firm*—Dorr, Carson, Sloan & Birney, P.C.

(57) ABSTRACT

An intelligent casino chip system. At least one gaming table is provided with at least one discrete player area. Two classes of intermingled gaming chips are accepted in the discrete betting area. Each gaming chip of the first class has a first transponder containing at least value information. Each gaming chip of the second class has a second transponder containing value and class information. The computer system determines the values from each class of chip and the class information from the second transponder.

20 Claims, 3 Drawing Sheets

Fig. 1
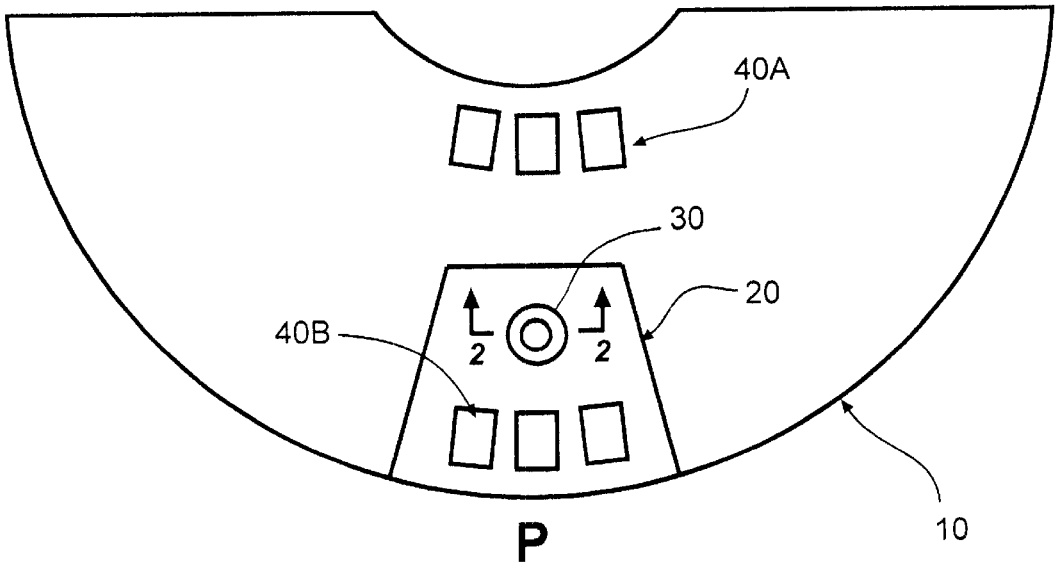
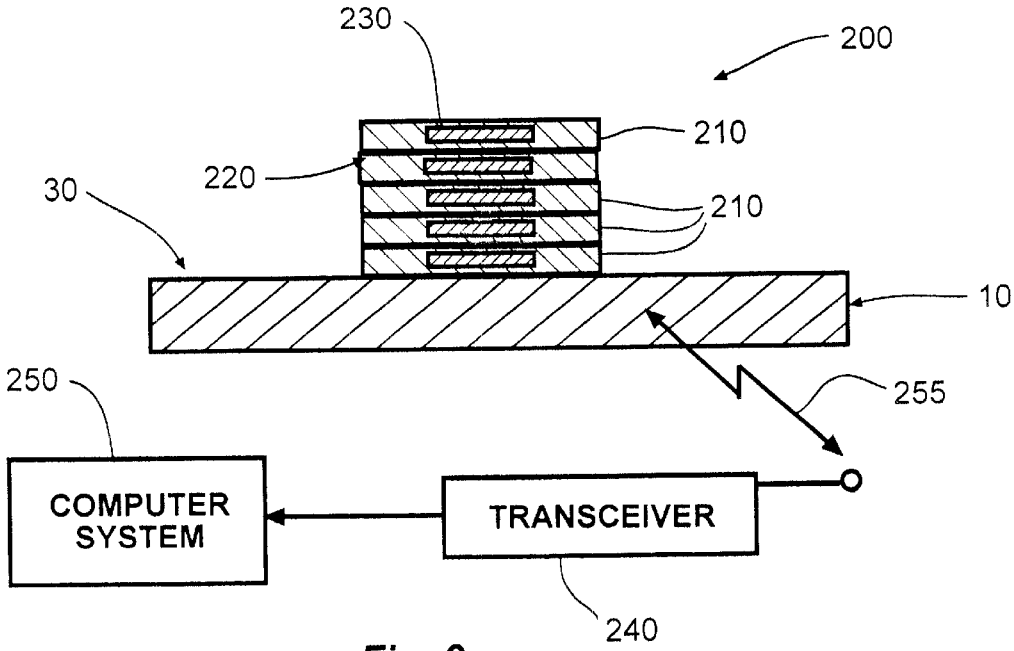
Fig. 2

INTELLIGENT CASINO CHIP SYSTEM AND METHOD FOR USE THEREOF

RELATED APPLICATION

This application is a continuation of Ser. No. 09/167,847 entitled "INTELLIGENT CASINO CHIP SYSTEM AND METHOD FOR USE THEREOF", filed on Oct. 7, 1998, now U.S. Pat. No. 6,186,895, and which claims the benefit under 35 U.S.C. § 119(e) of U.S. Provisional Application Ser. No. 60/061,297 filed on Oct. 7, 1997, entitled INTELLIGENT CASINO CHIP SYSTEM.

BACKGROUND OF THE INVENTION

1. Field of the Invention

The present invention relates to casino chips containing implanted computer-based transponders.

2. Statement of the Problem

A need exists to provide an intelligent casino chip system which allows a casino to accept and recognize a separate incremental wager on an existing betting position.

Conventionally, the casino advantage on card games such as blackjack amounts only to 1.5% to 2.0% and does not allow sufficient margin to fund bonuses or progressives that offer attractive pay outs. In contrast to conventional slot machines such as the popular $1.00 slot machine, such slot machines will generate more than twice the revenue per hour of play than a blackjack position at less than half the operating cost.

Conventional game variations on live card games have utilized the concept of an additional, incremental, bet in order to fund a bonus jackpot such as found in CARRIBEAN STUD or TWENTY-ONE MADNESS. In U.S. Patent Application No. 08/602,074 (McCrea), an invention pertaining to the use of a single game bet or wager for playing both a live card game and a progressive game is set forth.

Gaming chips with electronic circuits have been used in the past, including the following:

| Inventor | U.S. Pat. No. | Issue Date |
|---|---|---|
| Burpee et al. | 3,766,452 | Oct. 16, 1973 |
| Rendleman et al. | 5,166,502 | Nov. 24, 1992 |
| Modler | 5,361,885 | Nov. 8, 1994 |
| Plonsky et al. | 5,406,264 | Apr. 11, 1995 |
| French et al. | 5,651,548 | Jul. 29, 1997 |

U.S. Pat. No. 5,651,548 (Jul. 29, 1997) discloses gaming chips with electronic circuits that are scanned by antennas in gaming chip placement areas. The chips transmit information such as individual identification numbers which identify the particular chip and the value of the chip. The system includes an electronic system for receiving and storing the information from the antennas so that the location of the gaming chips can be tracked.

U.S. Pat. No. 5,166,502 (Nov. 24, 1992) discloses a fabrication process and the resulting gaming chip which utilizes an implanted electronic circuit encoded with identification information, which may include, but is not limited to, casino designation, chip value, serial number, and date of issue. The chip contains a programmable 32-bit transponder. In use, the transponder is electrically simulated by a reading device which causes the transponder to transmit the information stored in it. The encoded information which is read may then be processed by a computer or similar device. A computer program matches the encoded information with information stored in its data base and then decodes and outputs the information in a legible manner for immediate or later review.

U.S. Pat. No. 3,766,452 (Oct. 16, 1973) teaches a thin passive RLC resonant circuit embedded in the periphery of a chip or token. A signal generator and antenna are used to transmit a preselected frequency or narrow band of frequencies in which the resonant frequency of the chip falls. A receiver and antenna which are tuned to the preselected frequency or range of frequencies are placed across from the transmitter and antenna. When a chip or token containing the resonant circuit passes in front of the transmitting antenna, a tinging or sustained oscillation is produced in the chip which is detected by the receiver.

U.S. Pat. No. 5,361,885 (Nov. 8, 1994) teaches an anti-counterfeiting device for use with gaming chips. The device contains a special interchip formed of light-conducting material which is embedded in plastic gaming chips during fabrication. The interchip forms a plurality of fingers, each of which terminates and presents a lighted face at the edge of the chip. When light is shined on one of the faces of the interchip, it illuminates all of the interchip faces distributed along the edge of the chip. The number of faces can then be counted and used as an identifier of the type or dollar amount of the chip.

U.S. Pat. No. 5,406,264 (Apr. 11, 1995) discloses a gaming chip which contains an amorphous magnetic marker material which allows the gaming chip to be detectable by low frequency electronic article surveillance system.

SUMMARY OF THE INVENTION

1. Solution to the Problem

The present invention solves the above-stated problem by providing an intelligent casino chip system, and method for using the system, that differentiates between two classes of gaming chips intermingled within a single discrete betting area.

2. Summary

An intelligent casino chip system having a gaming table with at least one discrete player area is disclosed. Each player area has a discrete betting area for receiving gaming chips. Two classes of gaming chips are used. The gaming chip of the first class has a first transponder containing at least value information. The gaming chip of the second class has a second transponder containing value and class information. A primary game wager, containing gaming chips of the first class, is placed as a stack in the discrete betting area intermingled with a secondary game wager comprised of at least one second class gaming chip. A transceiver system is positioned on or near the gaming table so that it is within the vicinity of the betting area. The transceiver receives signals from the respective transponders. Hence, value signals are received from the first transponder and value and class signals are received from the second transponder. Each of these signals are conveyed to a computer system that then determines a primary wager value of the primary wager based only on the value signals received from the first transponder, and the secondary wager value of the secondary wager based on the value and class signals from the second transponder. These respective wager values can be combined or maintained separately for progressive gaming, player identification, etc. In any case, the computer system differentiates the secondary wager from the primary wager based on the different signals from the respective transponders. Thus, the computer is able to differentiate and value the separate (primary and secondary) wagers when the primary and secondary wagers are intermingled in a single stack in a single discrete betting area.

BRIEF DESCRIPTION OF THE DRAWINGS

The present invention can be more readily understood in conjunction with the accompanying drawings, in which:

FIG. 1 shows a top view of a gaming table having player areas and betting areas.

FIG. 2 is a cross-sectional view of the gaming table through the bet area, taken along lines 2—2 in FIG. 1.

DETAILED DESCRIPTION OF THE INVENTION

Figure 3:
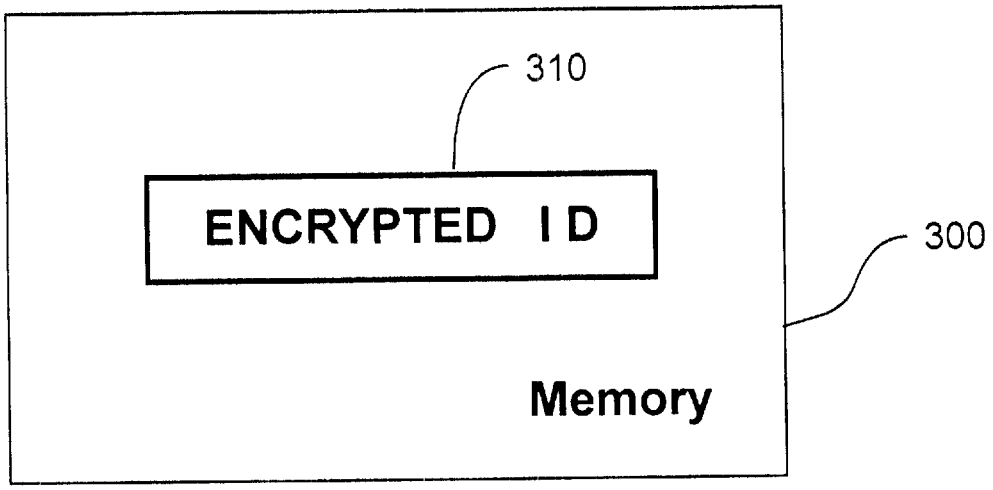
FIG. 3 shows a memory in the transponder of a special chip.

In FIG. 1 is set forth the top view of a gaming table 10 having a discrete player's area 20 and a discrete betting area 30. Any number of player positions 20 could be located on table 10. Furthermore, the shape of the player area 20 and the shape and location of the betting area 30 can be of any suitable design and location.

In FIG. 2, a cross-section of the table 10 taken along line 2—2 in FIG. 1 through the bet area 30 is shown. Placed in the betting area 30 by a player P sitting at the gaming table 10 is a bet 200 which comprises five intermingled casino chips of two types, 210 and 220. The bet 200 is shown to be in a stack but any suitable grouping of casino chips such as several stacks, individual chip placements, etc. could be provided and are equivalent. In each casino chip is an embedded transponder 230. The transponder 230 can be either active or passive. Located in a vicinity near the bet 200 is a transceiver system 240 for transmitting and for receiving signals 255 from each transponder 230. The term "vicinity" includes, but is not limited to, an area beneath the table 10, actually installed within the table 10, or above the table 10. The functional requirement is that the transceiver system 240 through use of electromagnetic waves 255 is able to receive and read information from each transponder 230 in each type of chip 210 or 220 so as to obtain at least the value of the chip. The transceiver 240 delivers this information to a computer system 250 which is capable of determining the value of the wager 200 placed by a player P at the player's playing area 20 in the betting area 30.

All of the above is conventional, except for the provision of a second class of chip 220. Chip 220 is a specially programmed chip. The chip 220 may have either a game denominational or a non-denominational value. A denominational value can be, for example, $1,000, $100, $20, $10, and $1. A non-denominational value can be for promotional purposes whereby a player could win a promotional prize such as free meals, free accommodations, cash prizes, trips, or merchandise.

In FIG. 3 is shown a memory 300 in the transponder 230 of special chip 220. Memory 300 has a data field 310 carrying an encrypted ID. This encrypted ID 310 identifies this chip as being of the second class 220 of casino chips and different from the class 210.

Hence, when the computer system 250 activates the transceiver 240 to ascertain the contents of bet 200, it will identify chips 210 of the first conventional class of gaming chips and retrieve the denominational value and identity code for each chip and it will recognize chip 220 as being of the second classification. Hence, the computer system 250 readily identifies casino chip 220 as a chip of the second type.

In one embodiment, the encrypted ID 310 stored in memory 300 of the transponder 230 in special chip 220 is used to identify chip 220 as a progressive wager. Hence, in a live card game 40 when a player P places the bet 200, the progressive bet chip 220 can be intermingled in the stack without regard to ordering or separation. Hence, effectively multiple wagers are placed in a single stack and are read by a single transceiver 240. The computer system 250 through use of the transceiver 240 precisely segregates chips 210 and 220 into separate classifications. Hence, the denominational value in chip 220 as read can be used as the bet for the progressive game. This is an important feature of the present invention since it eliminates a separate progressive bet area and separate progressive bet readers such as a chip reader, coin-in mechanism, etc. Under the teachings of the present invention, both the live card game wager and the progressive wager are placed in the same betting area 30 and the transceiver 240 under control of the computer system 250 ascertains the existence and value of the separate progressive bet. Any number of chips 220, and hence wagers, can be in bet 200.

Under a second embodiment, the encrypted ID 310 simply identifies the player P when placing a bet 200 in betting area 30 and the bet 200 can be used for both the live card game and the progressive game. This is similar to the approach set forth in U.S. patent application Ser. No. 08/602,074 (McCrea), now U.S. Pat. No. 5,707,289. This represents an improvement over the McCrea approach in that the player P makes a decision whether or not to participate in the live card game and the progressive game or to simply participate in the live card game. The special chip 220 simply identifies the player's bet 200 as qualifying for both the live card game and the progressive game.

The use of the special casino chip 220 encrypted as shown in FIG. 3 allows a casino to easily interface each particular gaming table 10 to either a bonus, a promotion, or a progressive system. Casinos would be able to conduct bonus periods on any combination of tables and games. For example, bonus periods could be conducted on one table, or on multiple tables, and either at the same time or at differing times. In addition, bonus periods could apply to blackjack alone or to blackjack and/or other card games.

As an example, the special casino chips 220 encrypted as shown in FIG. 3 could be utilized as a scheduled promotional event such as during the dinner hour when table games typically experience a decline in players. Casinos could hand out such special chips 220 to players for use during these scheduled events. A computer system 250 would only recognize the use of the special chips 220 during the scheduled event. For example, in FIG. 4, the scheduled event 400 could occur between 7:00 p.m. and 9:00 p.m. The computer system 250 has a real time clock. Should a player upon receiving the special bonus chip 220 sit at table 10 and insert chip 220 in bet 200 at times outside of the scheduled event 400, the computer 250 would ignore the special chip 220. However, if the player P places bet 200 with the computer chip 220 in betting area 30 during the scheduled event time 400, the computer system 250 would recognize the player P as participating in a progressive game or in a bonus, or other promotional pay out.

Figure 4:
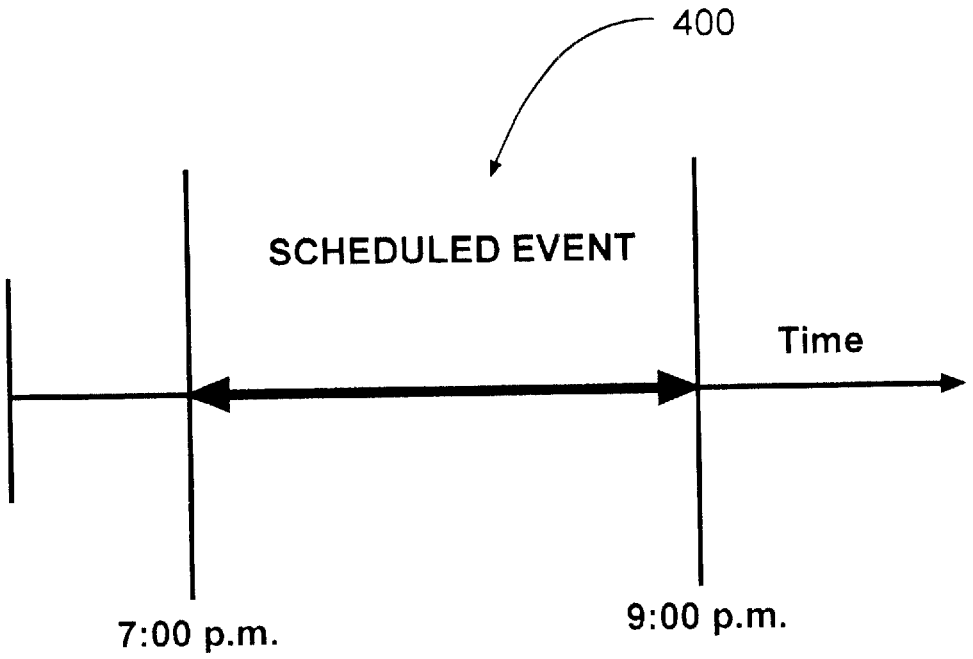
FIG. 4 shows a scheduled event.
Figure 5:
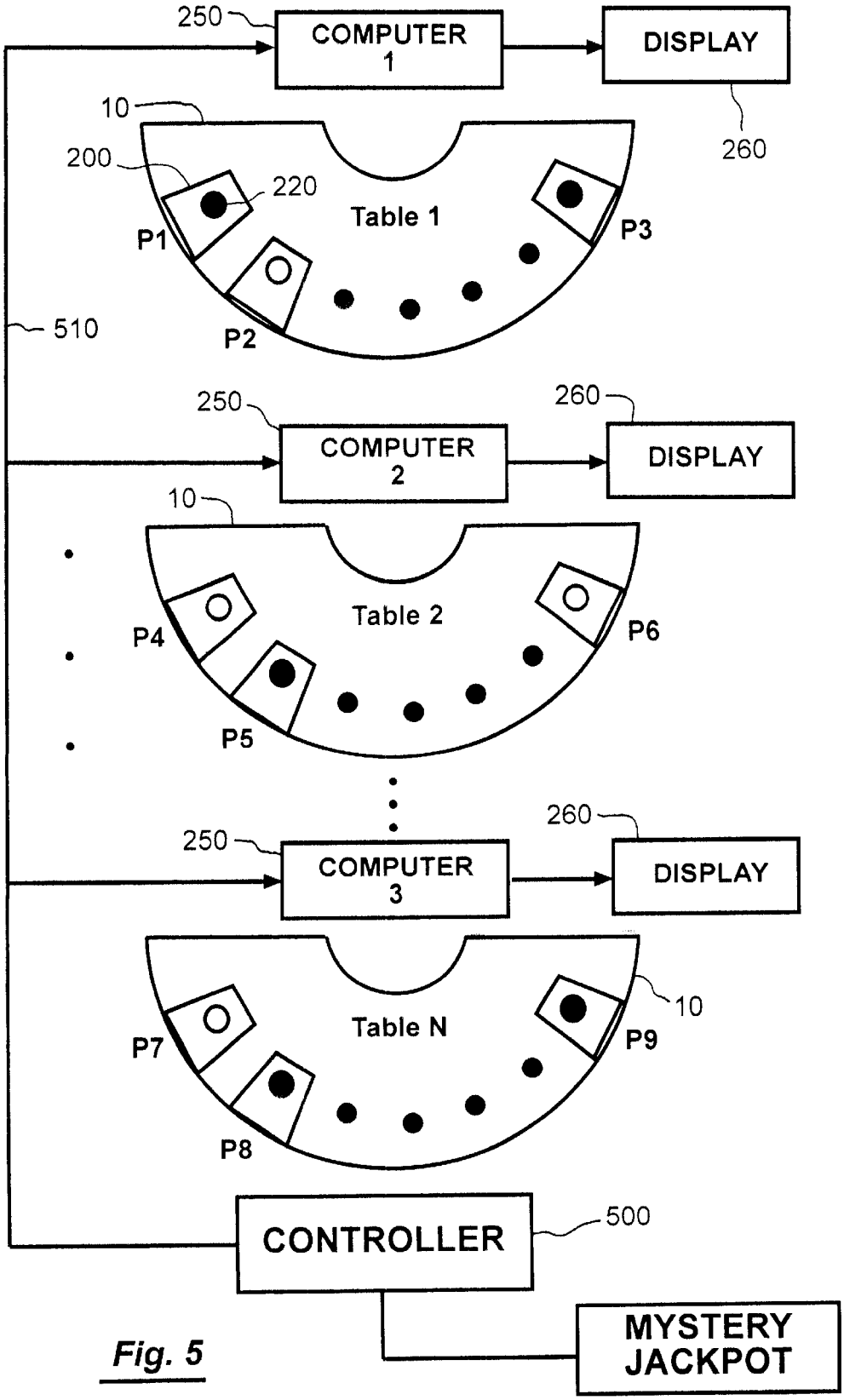
FIG. 5 shows a number of game tables interconnected to a controller over a network.

In FIG. 5, a number of game tables 10 are set forth interconnected to a controller 500 over a network 510. The following represents an example and is not meant to limit the teachings of the present invention. Players P1, P3, P5, P8, and P9 receive from the casino special chip 220 which is placed in a bet 200 along with the other chips 210. In FIG. 5, these players have their special chip 220 indicated as a darkened circle. It is to be expressly understood that other chips 210 may be present and that players P2, P4, P6, and P7, in this example, do not have special chip 220. The controller 500 having a real time clock only senses the presence of chips 220 during the time 400 of the scheduled event shown in FIG. 4. This special chip 220 is sensed by each computer 250 and delivered to controller 500. Controller 500 can incorporate a conventional MYSTERY JACKPOT™ such as that fully taught in U.S. Pat. No. 5,280,909 (Tracy). The presence of special chips 220 at player positions P1, P3, P5, P8, and P9 qualifies those players to also receive a MYSTERY JACKPOT™. This adds excitement to the live card game, attracts players to the tables, and increases the casino's business. While the above example sets forth scheduling the award of a MYSTERY JACKPOT™ during a time scheduled event 400 time frame, the teachings of the present invention are-not to be limited to a scheduled event 400.

For example, in using the players P1, P3, P5, P8, and P9 of the illustration in FIG. 5, such players could be awarded the special chip 220 based on their player performance such as monitored by a player tracker card which could be based upon length of time playing, amount of money won, amount of money played, or whatever suitable parameter the casino could use. The controller 500 would continuously run a separate bonus game such as MYSTERY JACKPOT™ in which event, the controller 500 would not be limited to a scheduled event time period 400 as shown in FIG. 4 but would continuously run the bonus period so that those players having the special chip 220 could always be included in a random jackpot bonus or other promotional period. The bonus pool can be funded independently by the casino, by a separate buy-in by the player, or by a percentage of the value of the chip 220.

It is to be expressly understood that the chips 220 could be used in a number of different capacities. These capacities include, but are not limited to, the following:

1. Carry a denominational value and be used to participate in a bonus promotion or progressive game.
2. Not carry a denominational amount, but qualify the player to participate in a bonus game or promotion either during a predetermined scheduled event time frame 400 or at any time.
3. Used as a promotional incentive distributed via marketing to potential players to entice them to play a live card game.
4. The special chips 220 can be part of a series of special chips with each special chip for a different promotion, even constituting restricted chips for junket play (that is, for special, predefined groups, chips could be issued to members of those groups allowing, for example, play on certain games for certain amounts or certain promotions).

It is to be understood that in all the embodiments discussed above, the players P use the special chips 220 without affecting or slowing down their normal speed of play. The only exception to this process would be to either sell or dispense the special chips to the player or to pay a winner.

Furthermore, the special chips 220 could be utilized to create a distinguishable signal that could be used to increment a meter, fund a bonus pool, fund a promotion, or as a triggering device.

The above disclosure sets forth a number of embodiments of the present invention. Other arrangements or embodiments, not precisely set forth, could be practiced under the teachings of the present invention and as set forth in the following claims.

I claim:

1. A method of differentiating two separate values in intermingled first and second classes of casino chips, said method comprising the steps of:

receiving primary signals from a first transponder embedded in at least one first class casino chip in the intermingled casino chips located on a single wagering area, said primary signals containing at least value information;

receiving secondary signals from a second transponder embedded in at least one second class casino chip in the intermingled casino chips on the single wagering area, said secondary signals containing value and identity information;

determining in a computer system a first value corresponding to the at least one first class casino chip based only on the value information from the received primary signals;

determining in said computer system a second value and class identity corresponding to the at least one second class casino chip based only on the value and identity information from the received secondary signals.

2. The method of claim 1 wherein the second value is a non-denominational value.

3. The method of claim 1 wherein the second value is a denominational value.

4. The method of claim 1 wherein the step of determining the second value and class identity further includes the step of qualifying a player to receive a jackpot.

5. The method of claim 1 further including the step of funding a bonus pool based on the presence of said second class casino chip.

6. A method for differentiating two separate values in intermingled casino chips, said method comprising the steps of:

receiving primary signals from a first transponder embedded in at least one first class casino chip located on a single wagering area, said primary signals containing at least value information;

receiving secondary signals from a second transponder embedded in at least one second class casino chip located on a single wagering area, said secondary signals containing value and identity information;

determining in a computer system a first value corresponding to the at least one first class casino chip based only on the value information from the received primary signals;

determining in said computer system a second value and class identity corresponding to the at least one second class casino chip based only on the value and class identity information from the received secondary signals wherein the step of determining the second value and class identity further includes the step of recognizing use of the second class casino chip only during scheduled promotional events.

7. The method of claim 1 wherein the step of determining the second value and class identity further includes the step of identifying said second class casino chip as a progressive wager.

8. The method of claim 1 wherein the step of determining the second value and class identity further includes the step of indicating that a player qualifies for both a live card game and a progressive game.

9. The method of claim 1 wherein the received secondary signals also includes player identity, and further including the step of determining in the computer system the identity of the player based on said received secondary signals.

10. The method of claim 1 wherein the step of determining the second value and class identity occurs only during a time period.

11. The method of claim 1 wherein the computer system uses the second value to issue a game signal corresponding to at least one of the following:

incrementing a meter, funding a bonus pool, funding a promotion, triggering a device.

12. An intelligent casino chip system for differentiating and valuing two separate wagers in first and second classes of casino chips, said casino chip system comprising:

at least one casino chip of a first class having a first transponder embedded therein, said first transponder at least containing value information;

at least one casino chip of a second class having a second transponder embedded therein, said second transponder at least containing value and class information;

a single game wager area for containing said at least one casino chip of said first class and said at least one casino chip of said second class;

a receiver system located in the vicinity of said single game wager area for receiving said value information from said at least one first transponder, said receiver system determining a first value only from the value information received from said at least one first transponder;

said receiver system further receiving said value and class information from said at least one second transponder, said receiver system determining a second value and identity based only on the value and class information received from said at least one second transponder, thereby differentiating said first and second values when said first and second category casino chips are placed in said single game wager area.

13. An intelligent casino chip system for differentiating and valuing two separate values in casino chips, said casino chip system comprising:

at least one casino chip of a first class having a first transponder embedded therein, said first transponder at least containing value information;

at least one casino chip of a second class having a second transponder embedded therein, said second transponder at least containing value and class information;

a single game wager area for containing said at least one casino chip of said first class and said at least one casino chip of said second class;

a receiver system located in the vicinity of said single game wager area for receiving said value information from said at least one first transponder, said receiver system determining a first value only from the value information received from said at least one first transponder; said receiver system further receiving said value and class information from said at least one second transponder, said receiver system determining a second value and identity based only on the value and class information received from said at least one second transponder, thereby differentiating said first and second category casino chips when placed in said single game wager area wherein the second transponder further comprises:

a memory having a data field;

an encrypted ID carried within said data field for identifying said at least one second class casino chip as being of said second class.

14. The intelligent casino chip system of claim 12 wherein said value and class information identifies said second class casino chip as a progressive wager.

15. The intelligent casino chip system of claim 12 wherein said value and class information identifies a player.

16. The intelligent casino chip system of claim 12 wherein said value and class information identifies a player as qualifying for both a live card game and a progressive game.

17. The intelligent casino chip system of claim 12 wherein said value and class information is denominational.

18. The intelligent casino chip system of claim 12 wherein said value and class information is nondenominational.

19. A casino chip system for differentiating and valuing two separate wagers of first and second classes of casino chips, said casino chip system comprising:

at least one gaming table having at least one discrete player area, said at least one discrete player area further having a discrete betting area;

at least one casino chip of a first class having a first transponder embedded therein, said first transponder at least containing value information;

at least one casino chip of a second class having a second transponder embedded therein, said second transponder at least containing value and class information;

a primary wager placed in said single, discrete betting area, said primary wager comprised of said at least one casino chip of said first class;

a secondary wager intermingled with said primary wager in said single, discrete betting area, said secondary wager comprised of said at least one second class casino chip;

a system located on said gaming table for receiving first transponder value signals from said first transponder and second transponder value and class signals from said second transponder;

a computer connected to said system, said system delivering said received first transponder value signals and second transponder value and class signals to said computer, said computer determining a primary wager value from said at least one first transponder value signals and a secondary wager value and identity from said at least one second transponder value and class signals, thereby differentiating and valuing said separate wagers when said primary wager and said secondary wager are intermingled.

20. The intelligent casino chip system of claim 19 further comprising:

a plurality of gaming tables; and an interface at each of said plurality of gaming tables for linking each of said plurality of gaming tables, wherein said value and class information is denominational.

* * * * *